United States Patent [19]

Murakami

[11] Patent Number: 4,571,203

[45] Date of Patent: Feb. 18, 1986

[54] FORM-CONVERTIBLE TOY ROBOT

[75] Inventor: Katsushi Murakami, Tokyo, Japan

[73] Assignee: Kabushiki Kaisha Bandai, Tokyo, Japan

[21] Appl. No.: 511,158

[22] Filed: Jul. 6, 1983

[30] Foreign Application Priority Data

Jul. 7, 1982 [JP] Japan ..... 57-118125

[51] Int. Cl.[4] ..... A63H 17/00; A63H 3/46

[52] U.S. Cl. ..... 446/95; 446/376; 446/487; 446/93

[58] Field of Search ..... 446/95, 94, 93, 96, 446/97, 99, 269, 268, 320, 321, 376, 431, 465, 470, 487, 433, 440, 230; D21/150, 128, 166, 87, 136

[56] References Cited

U.S. PATENT DOCUMENTS

| | | | |
|---|---|---|---|
| D. 278,643 | 4/1985 | Ogawa | 446/376 X |
| D. 279,592 | 7/1985 | Ogawa | D21/150 X |
| D. 279,916 | 7/1985 | Obara | D21/150 X |
| 2,623,329 | 12/1952 | Di Leva | 446/320 |
| 4,206,564 | 6/1980 | Ogawa | 446/94 |
| 4,391,060 | 7/1983 | Nakane | 446/94 |
| 4,411,097 | 10/1983 | Murakami | 446/73 |
| 4,516,948 | 5/1985 | Obara | 446/376 X |

FOREIGN PATENT DOCUMENTS

| | | | |
|---|---|---|---|
| 49-99393 | 8/1974 | Japan . | |
| 57-60694 | 4/1982 | Japan . | |
| 58-145694 | 9/1983 | Japan . | |
| 58-153889 | 10/1983 | Japan . | |
| 2128489 | 5/1984 | United Kingdom | 446/95 |

*Primary Examiner*—Mickey Yu

*Attorney, Agent, or Firm*—R. Gale Rhodes, Jr.

[57] ABSTRACT

A form-convertible toy robot comprises a body including a head, arms, shoulders, thighs, and legs. The head has a robot face on one surface thereof and a predetermined portion of the form on the other surface thereof. The arms with shoulders are mounted rotatably of the body and are in frictional engagement with the body. The thighs are mounted on the body either in fixed relation to the body or in rotational relation to the body. The legs are mounted on the thighs for rotational or slidable movement relative to the thighs. The toy robot can be converted into another form, such as a toy car, motorcycle, helicopter, tank or the like.

6 Claims, 16 Drawing Figures

FORM-CONVERTIBLE TOY ROBOT

BACKGROUND OF THE INVENTION

1. Field of the Invention

The present invention relates to a toy robot which can be converted into another form, such as a car, motorcycle, helicopter, tank, or the like, by changing relative position of one or more of the head, arms, legs, or thighs constituting the toy robot.

2. Description of the Prior Art

In conventional form-convertible toy robots, there is known in the art a toy robot of the type that can be converted into another form of rectangular shape by accommodating the head, arms, and legs into the body of the toy robot. Such a known toy robot, however, can not be utilized as another toy different in nature and shape from the original toy robot, and also as another toy more attractive for children.

SUMMARY OF THE INVENTION

It is, therefore, a principal object of the present invention to provide a novel form-convertible toy robot which can be utilized not only as a toy robot itself but also another toy which is different in nature and shape from the original toy robot, and which is more attractive for children.

A toy robot convertible into another form according to the present invention comprises a body including a head, arms, shoulders, thighs, and legs. The head has a robot face on one surface thereof and a predetermined portion of the form on the other surface thereof. The arms with shoulders are mounted rotatably on the body and are in frictional engagement with the body so that the arms and shoulders can be held at a desired angle with respect to the body. The thighs are so mounted on the body that the thighs can take one of two arrangements, one arrangement being that of a fixed relation to the body, and the other arrangement being that of a rotatable relation to the body and in frictional engagement with the body so that the thighs can be held at a desired angle relative to the body. The legs are mounted on the thighs for frictional movement relative to the thighs so that the legs can be held at a desired angle relative to the thighs. With this construction, the toy robot can be converted into another form, such as a car, motorcycle, helicopter, tank or the like. The conversion can be carried out by rotating the arms and shoulders to take a predetermined positions, by moving the legs to take a predetermined position, and by causing the thighs to take one of the two positions.

The foregoing and other objects, the features and the advantages of the present invention will be pointed out in, or apparent from, the following description of the preferred embodiments considered together with the accompanying drawings.

BRIEF DESCRIPTION OF THE DRAWINGS

FIG. 1 and FIG. 2 are front and side elevational views, respectively, and FIG. 3 is a side view of the car converted from the toy robot;

FIGS. 8 and 9 are front and side elevational views, respectively, and FIG. 10 is a side elevational view of the motorcycle converted from the toy robot;

FIGS. 11 and 12 are front and side elevational views, respectively, and FIG. 13 is a side elevational view of the helicopter converted from the toy robot; FIGS. 14 and 15 are front and side elevational views, respectively, and FIG. 16 is a side elevational view of the battle tank converted from the toy robot.

DETAILED DESCRIPTION OF THE PREFERRED EMBODIMENTS

The invention will now be described with reference to the accompanying drawings.

FIGS. 1 to 7 show a first embodiment of the form-convertible toy robot which can be changed into a car. In the figure, a reference number 1 denotes a body of the toy robot. The body 1 is provided with a head 2. As particularly shown in FIG. 7, the head 2 is rotatably mounted on the body 1 by means of an axle 2*a* coupled to the body 1. The head 2 has a robot face on one surface thereof and a hood for the car on the other surface thereof. Shoulders 3,3 are formed integrally with arms 4,4, and are mounted on the opposite upper sides of the body 1.

Figure 4:
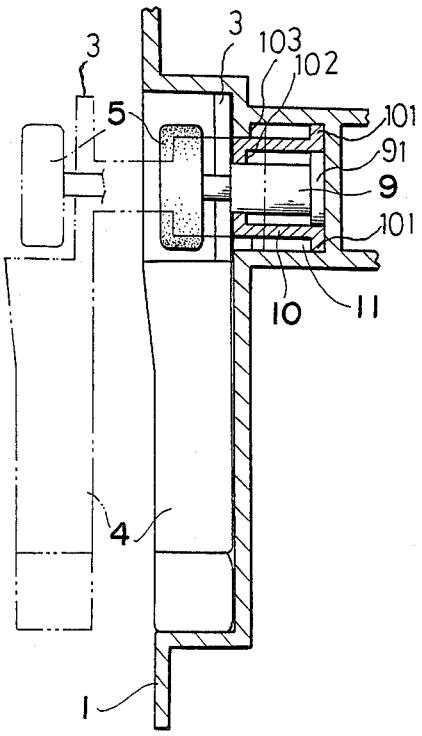
FIG. 4 is a partial bottom cross sectional view of the toy robot of FIG. 1, illustrating the mounting structure of the arm and shoulder thereof in relation to the body of the toy robot.
Figure 5:
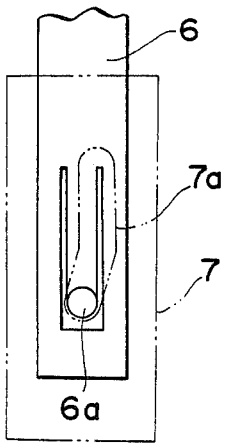
FIG. 5 is a front elevational view of the thigh with the leg shown by a phantom line, illustrating the engaging state of the leg and the thigh of the toy robot of FIG. 1.
Figure 6:
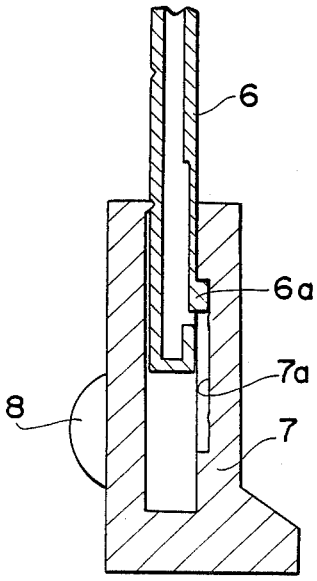
FIG. 6 is a side cross sectional view, illustrating the engagement relation between the thigh and the leg of the toy robot of FIG. 1.
Figure 7:
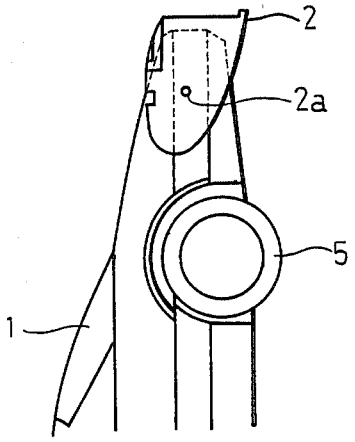
FIG. 7 is a partial side elevational view, illustrating the mounting of the head on the body of the toy robot of FIG. 1.

As shown in detail in FIG. 4, outwardly of the shoulder 3, a front wheel 5 is positioned. The front wheel 5 is rotatably mounted on a wheel axle which is secured to a cylindrical sliding member 9 and also to the shoulder 3. The sliding member 9 has a flange 91 on one end thereof, and is slidable with friction along the inner wall of a hollow tube 10 surrounding the sliding member 9, the wheel axle being fixed to the other end of the sliding member 9. The hollow tube 10 has protrusions 101 on one end thereof, and is frictionally and slidably mounted in a recess provided in the body 1. An inwardly extending projection 102 is formed on the other end of the hollow tube 10. A linear convexity 11 provided beneath the protrusions 101 serves as a guide for preventing rotation of the hollow tube 10 within the recess. The recess is provided with a projected wall 103 which is formed to abut against the protrusions 101.

Thighs 6,6 are formed fixedly and integrally with the body 1, and extend downwardly from the body 1. The thighs 6,6 are insertedly mounted on legs 7,7 which can be contracted till the upper edges thereof reach the lower edge of the body 1 by sliding on the thighs 6,6. As particularly shown in FIGS. 5 and 6, each thigh 6 is provided, at the lower portion thereof, with a guiding projection 6*a* which engages with a guide groove 7*a* formed on the inner surface of the leg 7, thereby the leg 7 being guided along the thigh 6 for contraction and expansion relative to the thigh 6. A rear wheel 8 is also mounted on a wheel axle (not shown) coupled within and to the leg 7.

Figure 1:
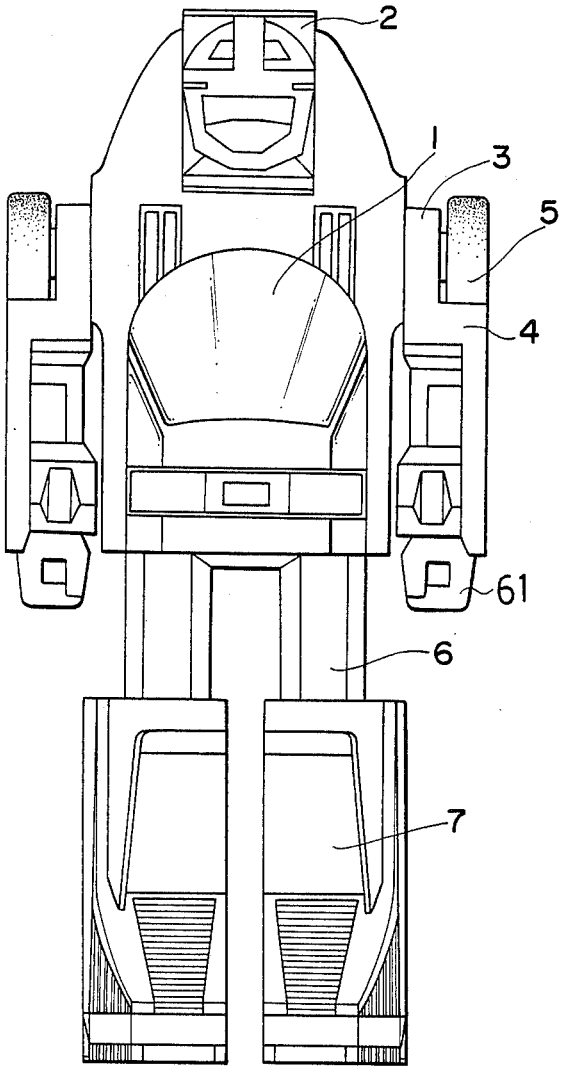
FIGS. 1 to 3 show a first embodiment of the toy robot capable of being converted into a car according to the invention.
Figure 2:
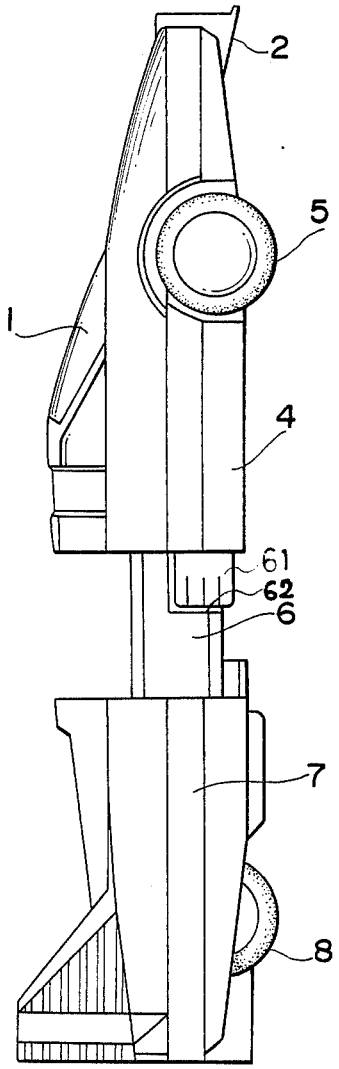
Figure 3:
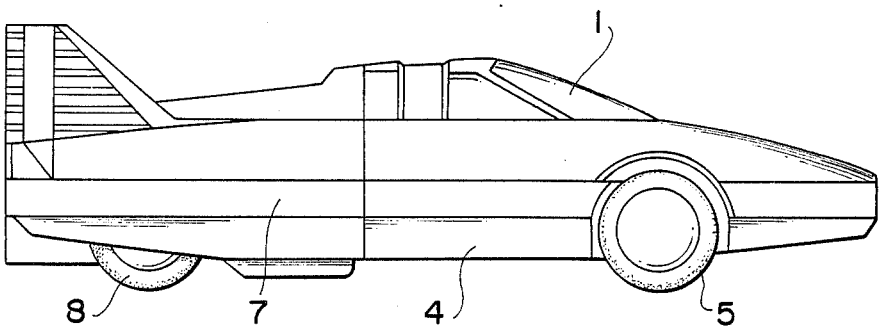

The conversion of the toy robot thus constructed as shown in FIGS. 1 and 2 into the form of the car as shown in FIG. 3 can be accomplished in the following manner. First, the head 2 of the toy robot is rotated to make the hood portion appear on the upper side of the car to be finished. The legs 7,7 are then pulled down from the thighs 6,6. In this condition, fists 61,61 covered by the legs 7,7 are exposed for preparation of the next process. The arms 4,4, fists 61,61, and shoulders 3,3 which have been accommodated within recesses 62,62 formed on the sides of the thighs 6,6 and the body 1, are pulled collectively therefrom. In the pulling operation of the arm 4, fist 61, and shoulder 3, the sliding member 9 with the flange 91 is pulled out from the interior of the hollow tube 10 until the flange 91 abuts against the projection 102, and similarly the hollow tube 10 is pulled out from the recess by being guided by the convexity 11 which engages with the protrusions 101. The shifting of the hollow tube 10 continues until the protrusions 101 abut against the projected wall 103 of the recess. The above operation leads to the presentation of the finished toy robot. The return of the car to the toy robot can be carried out by the operation in a reverse manner as above.

Figure 8:
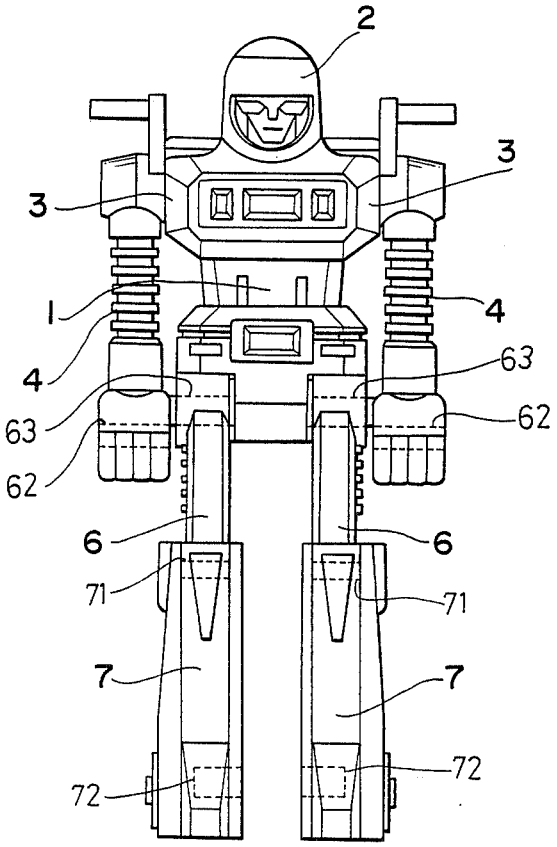
FIGS. 8 to 10 show a second embodiment of the toy robot capable of being converted into a motorcycle according to the present invention.
Figure 9:
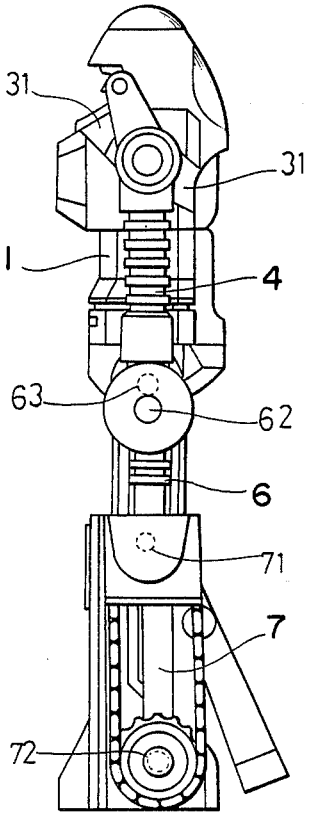
Figure 10:
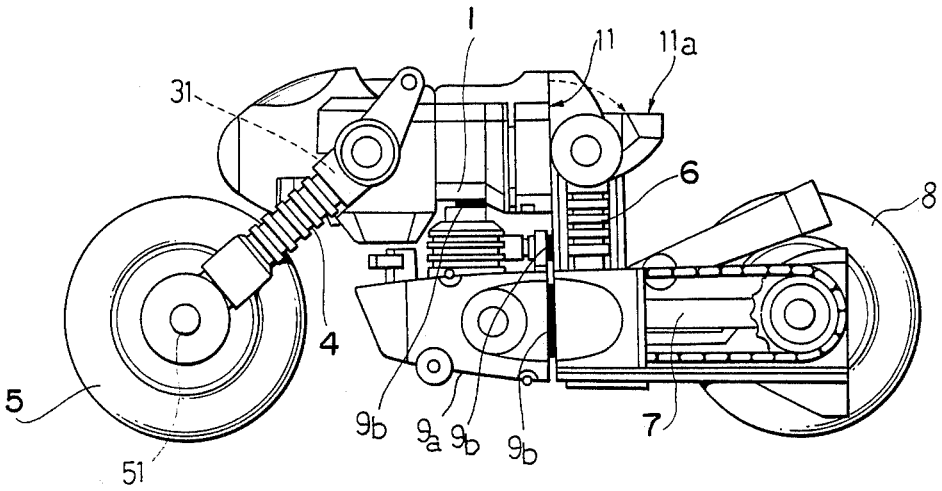

FIGS. 8 to 10 show a second embodiment of the form-convertible toy robot which can be changed into a motorcycle, wherein identical reference numerals have been used to designate corresponding parts of the first embodiment. The difference of the second embodiment from the first one is first described, and the other similar construction to the toy robot shown in FIG. 1 is omitted for the purpose of simplicity. The shoulders 3,3 are provided with grooves 31,31 formed on the opposite sides of the shoulders 3,3. The direction of the grooves 31,31 are inclined with respect to the body 1 so that when the arms 4,4 are compressedly received by rotating around the body 1 to correctly locate above the grooves 31,31 and then by pushing into the grooves 31,31, the arms 4,4 serve as a bifurcated fork of the motorcycle as shown in FIG. 10. The fist 61 is provided with a through hole 62 into which a wheel axle 51 is inserted for rotational supporting of the front wheel 5.

The thighs 6,6 are frictionally and rotatably mounted on respective axles 63,63 formed within the body 1 such that the thighs 6,6 can be folded at a right angle relative to the body 1 as shown in a dotted line in FIG. 10. Two surfaces 11, 11*a* respectively of the body 1 and the thigh 6 abut against each other to define the correct posture of the toy robot when it is converted into the toy robot.

The legs 7,7 are frictionally and rotatably mounted on respective axles 71,71 formed within the thighs 6,6 such that the legs 7,7 can be folded at a right angle relative to the thighs 6,6. A pair of cylindrical holes 72,72 are provided at the lower end portion of the legs 7,7 into which a wheel axle (not shown) is inserted for rotational supporting of the rear wheel 8.

The conversion of the thus constructed toy robot as shown in FIGS. 8 and 9 into a toy motorcycle can be carried out in the following ways. The arms 4,4 are first pulled out from the body 1 as illustrated in the first embodiment. And then the arms 4,4 are compressedly received in the grooves 31,31 formed on the shoulders 3,3. The front and rear wheels 5 and 8 which have previously and independently been prepared are mounted on respective wheel axles. Additional engine member 9*a* can be attached beneath the motor cycle by means of coupling extensions 9*b* which are inserted into recesses formed on the body 1 and thighs 6,6 and legs 7,7. Thus, the conversion can be fulfilled.

Figure 11:
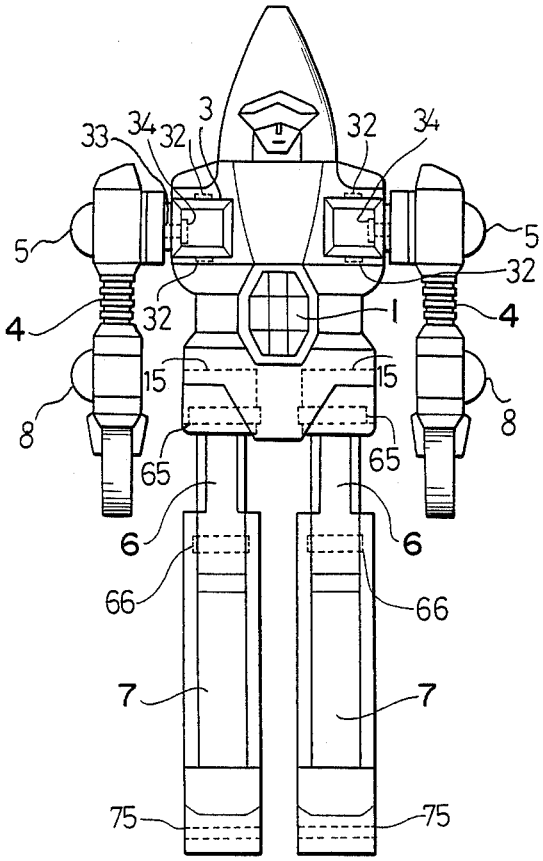
FIGS. 11 to 13 show a third embodiment of the toy robot capable of being converted into a helicopter according to the present invention.
Figure 12:
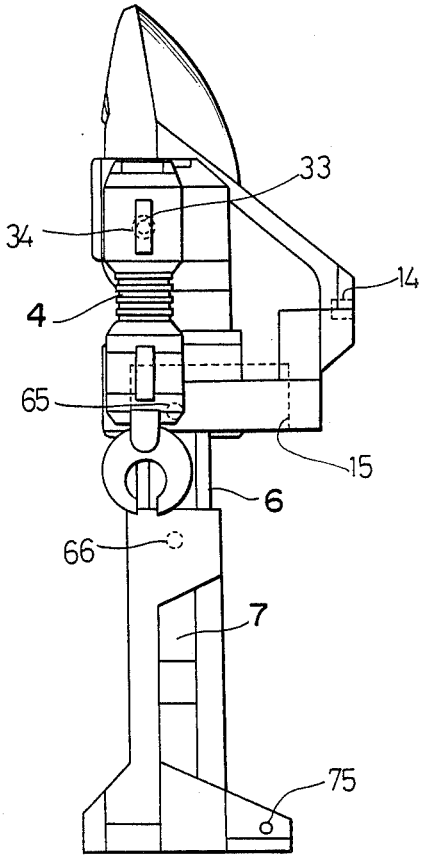
Figure 13:
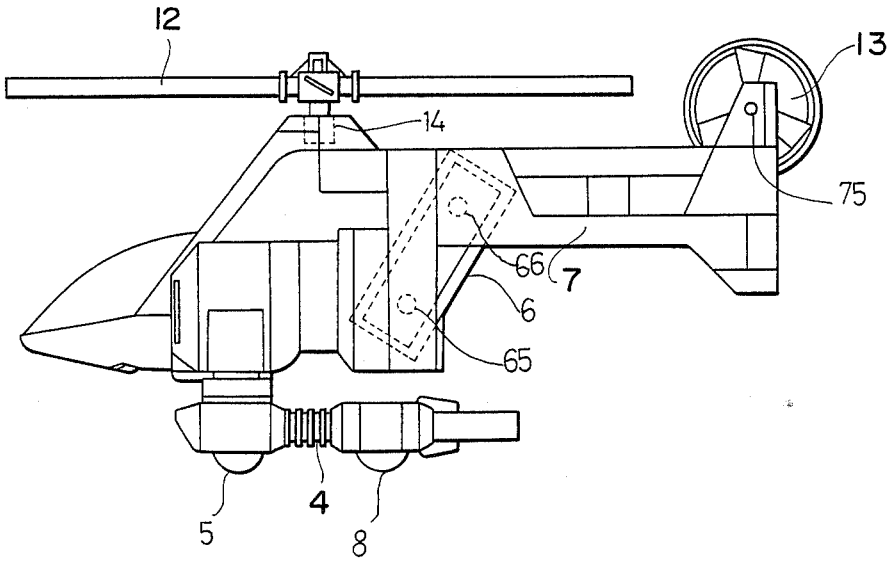

FIGS. 11 to 13 show a third embodiment of the form-convertible toy robot which can be changed into a toy helicopter, wherein identical reference numerals have been used to designate corresponding parts of the first embodiment. The difference of the third embodiment from the first one is described, and the other similar construction to the toy robot shown in FIG. 1 is omitted for simplicity purpose. Each of the arms 4,4 is provided with a pair of wheels 5 and 8 rotatably mounted on the arm 4. Articulations or shoulders 3,3 are rotatably and frictionally mounted within the body 1 by means of axles 32,32 which are pivoted on respective bearings (not shown) formed on the body 1. The arms 4,4 are also rotatably and frictionally mounted on the articulations 3,3 by means of connecting rods 33,33 with flange portions 34,34, the flange portions 34,34 engaging with the articulations 3,3 at the interior thereof. The body 1 is provided with a reception hole 14 for rotatable supporting of a main rotor 12 of the helicopter.

The body 1 is formed with a recess 15 into which the thighs 6,6, when move toward the back of the body 1, are partially accommodated as shown in FIG. 13 by a phantom line. The thighs 6,6 are rotatably and frictionally coupled to the body 1 through axles 65,65 mounted within the body 1. The legs 7,7 are rotatably and frictionally coupled to the thighs 6,6 through axles 66,66 mounted within the respective thighs 6,6. A through hole 75 is provided on each of the legs 7,7 at the lower portion thereof for rotational supporting of a rear rotor 13.

The main and rear rotors 12 and 13 are additionally provided for completion of the helicopter which are not used for the toy robot itself.

By the provision of two rotational movements in conjunction with the arm 4, the arms 4,4 can be rotated in front of and along the longitudinal direction of the toy robot body 1 as shown in FIG. 13. Thus, the arms can serve as ground arms with wheels 5 and 8. And by the provision of the recess 15, the thighs 6,6 can be partially received within the recess 15 so that the legs 7,7 can be rotated to be aligned in parallel relation to the longitudinal direction of the toy robot body 1. The conversion between the two alternative forms can be readily understood from the above description.

Figure 14:
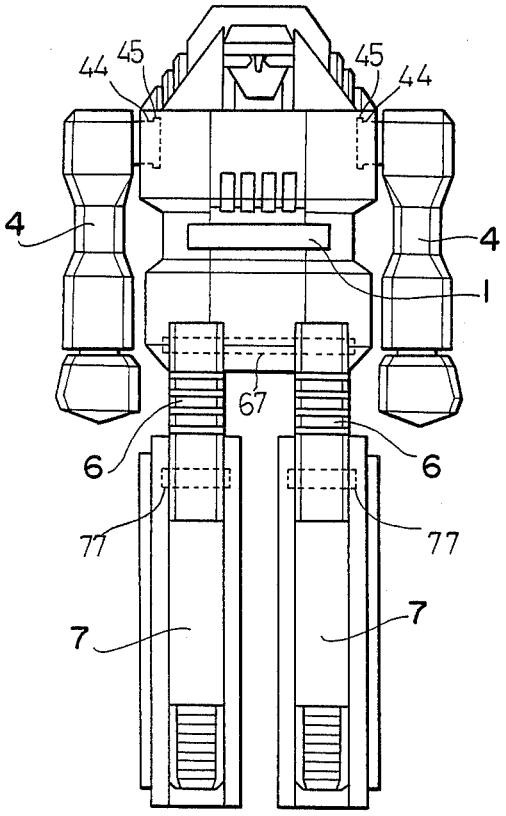
FIGS. 14 to 16 show a fourth embodiment of the toy robot capable of being converted into a tank according to the present invention.
Figure 15:
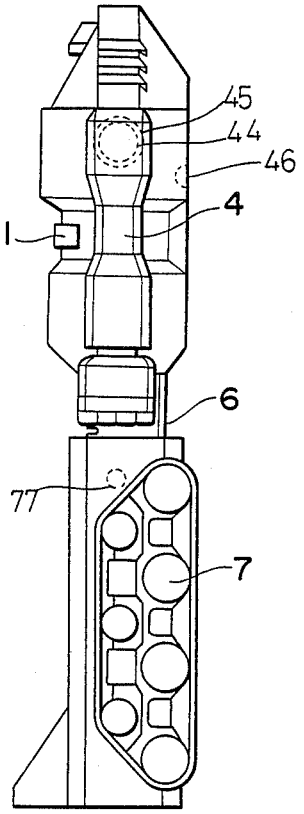
Figure 16:
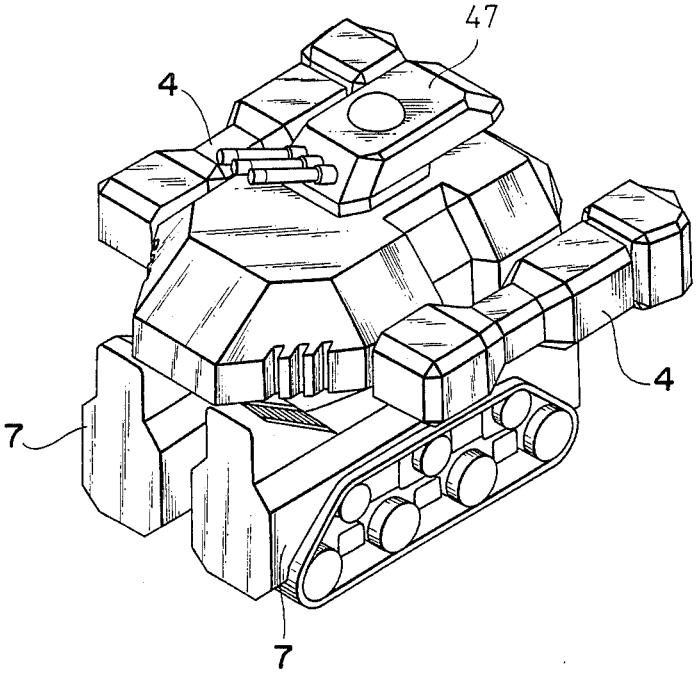

FIGS. 14 to 16 show a fourth embodiment of the form-convertible toy robot which can be changed into a toy battle tank, wherein identical reference numerals have been used to designate corresponding parts of the first embodiment. The difference of the fourth embodiment from the first one is described, and the other similar construction to the toy robot shown in FIG. 1 is omitted for the purpose of brevity. The arms 4,4 are rotatably and frictionally coupled to the body 1 through coupling rods 44,44 with flanges 45,45 which engage with the interior of the body 1. The body 1 is formed with a reception hole 46 into which a guns member 47 is rotatably coupled.

The thighs 6,6 are coupled to the body 1 through an integral axle 67 mounted within the body 1, and the legs 7,7 are coupled in rotational and frictional movement relative to the thighs 6,6 by means of respective axles 77,77 mounted on the thighs 6,6.

By the provision of the two rotational movements of the thighs 6,6 and legs 7,7, the thighs can be folded under the front body of the toy robot, and the legs 7,7 can be folded under the thus folded thighs 6,6 to complete the finished posture simulating the toy battle tank, as shown in FIG. 16.

Finally, the guns member 47 is provided on the back of the body 1. Thus, the conversion from the toy robot into the toy tank is attained. The reverse operation as above can be carried out in order to make the toy robot as shown in FIGS. 14 and 15.

Other embodimens of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A toy robot convertible into another form, comprising:

a body including integrally interconnected and relatively movable head, arms, shoulders, thighs and legs;

said head having a robot face on one surface thereof and a predetermined portion of said form on the other surface thereof;

said arms with shoulders being mounted rotatably on said body and being in frictional engagement with said body so that said arms and shoulders can be held at a desired angle with respect to said body;

said thighs being so mounted on said body that said thighs can take one of two positions, one position being that of a fixed relation to said body, and the other position being that of a rotatable relation to said body and in frictional engagement with said body so that said thighs can be held at a desired angle relative to said body;

said legs being mounted on said thighs for frictional movement relative to said thighs so that said legs can be held at a desired angle relative to said thighs; and upon said arms and shoulders being rotated to take a predetermined position, said thighs being caused to take one of said positions, and said legs being moved to take a predetermined position, said toy robot being converted into said another form.

2. A form-convertible toy robot as set forth in claim 1, wherein said head is mounted rotatably and said predetermined portion is a hood for a car;

said arms and shoulders formed integral therewith are further mounted for compressing movement into and out of said body, each of said shoulders being provided with a front wheel rotatably mounted on an axle coupled to said shoulder;

said thighs take said one position; and said legs are mounted for contracting and expanding movement relative to said thighs and are slidably on said thighs, each of said legs being provided with a rear wheel rotatably mounted on an axle coupled to each of said legs; and wherein said another form takes a figure of said car.

3. A form-convertible toy robot as set forth in claim 1, wherein said arms and shoulders formed integral therewith are held at an inclined angle relative to said body in order to serve as a bifurcated front fork for a motorcycle, said arms being provided at the end portions thereof with a front wheel rotatably mounted on an axle coupled between said end portions;

said thighs are rotatably mounted to be folded at a right angle relative to said body; and said legs are rotatably mounted to be folded at a right angle relative to said right angularly folded thighs, said legs being provided at the end portions thereof with a rear wheel rotatably mounted on an axle coupled between said end portions;

and wherein said another form takes a figure of said motorcycle.

4. A form-convertible toy robot as set forth in claim 1, wherein said shoulders are rotatably mounted within said body and said arms are rotatably mounted on said shoulders, and each of said arms is provided with front and rear wheels rotatably mounted on axles coupled within said each arm, whereby said arms can be positioned along and in front of said body for serving as ground arms for a helicopter;

said thighs are rotatably mounted to be inclined relative to said body;

said legs are rotatably mounted to be aligned in parallel relation to the lengthwise direction of said body, said legs being provided at the end portions thereof with a rear rotor for said helicopter, and said body is further provided at the back portion thereof a main rotor for said helicopter, and wherein said another form takes a figure of said helicopter.

5. A form-convertible toy robot as set forth in claim 1, wherein said thighs are rotatably mounted to be folded at a right angle relative to said body;

said legs are rotatably mounted to be folded at a right angle relative to said right angularly folded thighs, whereby said legs are positioned along and in front of said body for serving as a continuous tread for a tank; and said body is further provided with guns on the back portion thereof; and wherein said another form takes a figure of said tank.

6. A toy robot convertible into another toy which is different in nature and shape from said toy robot, comprising:

a body including integrally interconnected and relatively movable head, arms, shoulders, thighs and legs;

said head mounted rotably on said body and having a robot face on one surface thereof and a predetermined portion of said another toy on another surface thereof;

said arms and shoulders mounted rotatably on said body and being in frictional engagement with said body so that said arms and shoulders can be held at a desired angle with respect to said body;

said thighs mounted on said body such that said thighs can take one of two positions relative to said body, one position being that of a fixed relation to said body and the other position being that of a rotatable relation to said body and in frictional engagement with said body so that said thighs can be held at a desired angle relative to said body;

said legs being mounted on said thighs for frictional sliding relative movement relative to said thighs so that said legs can be held at a desired position relative to said thighs; and upon said head, arms and shoulders being rotated to take a predetermined position, said thighs being caused to take one of said positions and said legs being moved to take a predetermined position, said toy robot being converted into said another toy.

* * * * *